US006065247A

United States Patent [19]

Sundvall

[11] Patent Number: 6,065,247

[45] Date of Patent: May 23, 2000

[54] PIVOTABLE STRUCTURE

[75] Inventor: Björn Sundvall, Västra Frölunda, Sweden

[73] Assignee: Global Financial Ltd., Gibraltar, United Kingdom

[21] Appl. No.: 08/501,042

[22] PCT Filed: Jun. 9, 1993

[86] PCT No.: PCT/SE93/00508

§ 371 Date: Sep. 20, 1995

§ 102(e) Date: Sep. 20, 1995

[87] PCT Pub. No.: WO94/19570

PCT Pub. Date: Sep. 1, 1994

[30] Foreign Application Priority Data

Feb. 16, 1993 [SE] Sweden ..... 9300496

[51] Int. Cl.[7] ..... E05D 15/58

[52] U.S. Cl. ..... 49/258; 49/127

[58] Field of Search ..... 49/125, 127, 128, 49/129, 130, 254, 258, 260

[56] References Cited

U.S. PATENT DOCUMENTS

| | | | |
|---|---|---|---|
| 2,701,896 | 2/1955 | Fritz | 20/19 |
| 3,060,521 | 10/1962 | Greco | 49/127 X |
| 3,303,612 | 2/1967 | Baker | 49/127 |
| 3,462,882 | 8/1969 | Brown, Jr. | 49/181 |
| 3,654,732 | 4/1972 | Schacht | 49/127 |
| 3,810,330 | 5/1974 | Daggy | 49/127 |
| 4,068,406 | 1/1978 | Wood | 49/181 |
| 4,559,739 | 12/1985 | Bayer | 49/177 |
| 4,619,074 | 10/1986 | Leung et al. | 49/125 X |
| 5,272,839 | 12/1993 | Karhu | 49/127 X |

FOREIGN PATENT DOCUMENTS

| | | |
|---|---|---|
| 0072267 | 2/1983 | European Pat. Off. . |
| 887109 | 11/1943 | France . |
| 90/12183 | 10/1990 | WIPO . |
| 93/08355 | 4/1993 | WIPO . |

*Primary Examiner*—Jerry Redman
*Attorney, Agent, or Firm*—Henderson & Sturm LLP

[57] ABSTRACT

A pivotable, sliding, glazing structure is disclosed which comprises one or more panes supported between upper and lower guide-rails for horizontal sliding movement along the rails. Each pane has a leading edge and a trailing edge and is adapted to perform a pivoting motion about its leading edge at a respective predetermined position for each pane along the guide-rails. This is achieved by means of a pivot arrangement carried on the pane and arranged in the vicinity of the leading edge. The structure allows the pivot arrangement to be locked against further sliding movement when each pane reaches its respective predetermined position by displacing a portion of the pane inwardly so that at least a part of the pivot arrangement is held in a receiving element mounted on one of the guide-rails.

20 Claims, 5 Drawing Sheets

PIVOTABLE STRUCTURE

TECHNICAL FIELD

The present invention relates to a pivotable, sliding, glazing structure primarily intended for use on balconies, verandas, terraces, etc.

BACKGROUND OF THE INVENTION

Traditional glazing for balconies or the like consists of a plurality of sashed glass panes mounted on upper and lower guide rails and adapted to slide laterally past one another. A major disadvantage with this type of glazing is that at most only 50% of the glazed-in area can be opened. Furthermore, the outer surfaces of the panes are awkward to clean.

Glazing structures have thus been proposed in which the panes can be stacked against a side wall of the balcony by pivoting about a vertical axis. In WO 89/05389 this is achieved by means of a double upper rail arrangement having a straight outer rail and an inner rail which curves inwardly towards the side wall of the balcony. Two slides are provided on the upper edge of each pane, one of which moves along the straight outer rail and the other along the inner rail. Within the curved portion of the inner rail the trailing edge of the pane turns inwards and the pane can be opened against the side wall of the balcony. Such an arrangement is however not particularly aesthetically pleasing and considerable friction can arise in the system.

In an effort to eliminate these drawbacks, WO 90/121183 proposes a structure in which the top edge pivot pin of the glass pane is fitted with a latch which immobilizes the pivot pin with respect to the upper rail when the pane is pivoted about the pivot pin. Since the leading edge of the pane is held stationary, no curved guide rail for the trailing edge is required. Whilst eliminating some of the disadvantages of the prior systems, the arrangement according to WO 90/121183 introduces its own drawbacks, one being that the pane must be tilted to disengage the upper trailing wheel from its guide rail before pivoting can commence. Since the leading edge of the pane is locked first only when pivoting has commenced, there is a risk that the trailing wheel may not disengage should the pane topple back before pivoting commences. The fact that the leading edge is locked only once rotation has commenced further implies that a flange protruding from the upper guide rail adjacent the opening for the trailing wheel is required to support the trailing wheel during the initial opening operation. Such protruding flanges hinder the possibility to mount curtains or blinds across the glazing. In addition, because only the upper leading pivot pin is immobilized, the pane cannot be opened through more than 90° due to the fact that the lower leading pivot pin would otherwise be forced along the lower guide rail as a result of the change in position of the center of gravity of the pane.

One solution to the problems described above is the subject of Swedish patent application no. 9000287-4. Said application discloses a pivotable, sliding, glazing structure comprising one or more panes supported between upper and lower guide-rails for horizontal sliding movement therealong, each pane having a leading edge and a trailing edge and being adapted to perform a pivoting motion about its leading edge at a predetermined position along said guide-rails by means of a pivot arrangement carried on said pane and arranged in the vicinity of the leading edge, said structure further comprising means for locking the pivot arrangement at said predetermined position before and during said pivoting motion.

Whilst the above structure offers certain benefits over prior arrangements, actuation of the locking means is relatively complicated.

SUMMARY OF THE INVENTION

It is therefore an object of the present invention to provide a glazing structure which is simple in construction whilst at the same time offering ease of operation.

In accordance with the present invention, this object is achieved by means of a glazing structure comprising upper and lower guide-rails, a receiving element mounted on one of said guide-rails and at least one pane supported between said guide-rails for horizontal sliding movement therealong, each said at least one pane having a leading edge, a trailing edge and a pivot arrangement arranged in the vicinity of the leading edge, said pivot arrangement being adapted to allow said pane to perform a pivoting motion about said leading edge at a respective predetermined position for each pane along said guide-rails, said structure further comprising means for locking said pivot arrangement against further sliding movement at said predetermined position before and during said pivoting motion, said means for locking said pivot arrangement at said predetermined position comprising means for displacing a portion of said pane inwardly to cause at least a part of said pivot arrangement to enter and to be held in said receiving element.

BRIEF DESCRIPTION OF THE DRAWINGS

The invention will be described in more detail in the following by way of example only and with reference to the attached drawings in which.

BEST MODE OF CARRYING OUT THE INVENTION

Figure 1:
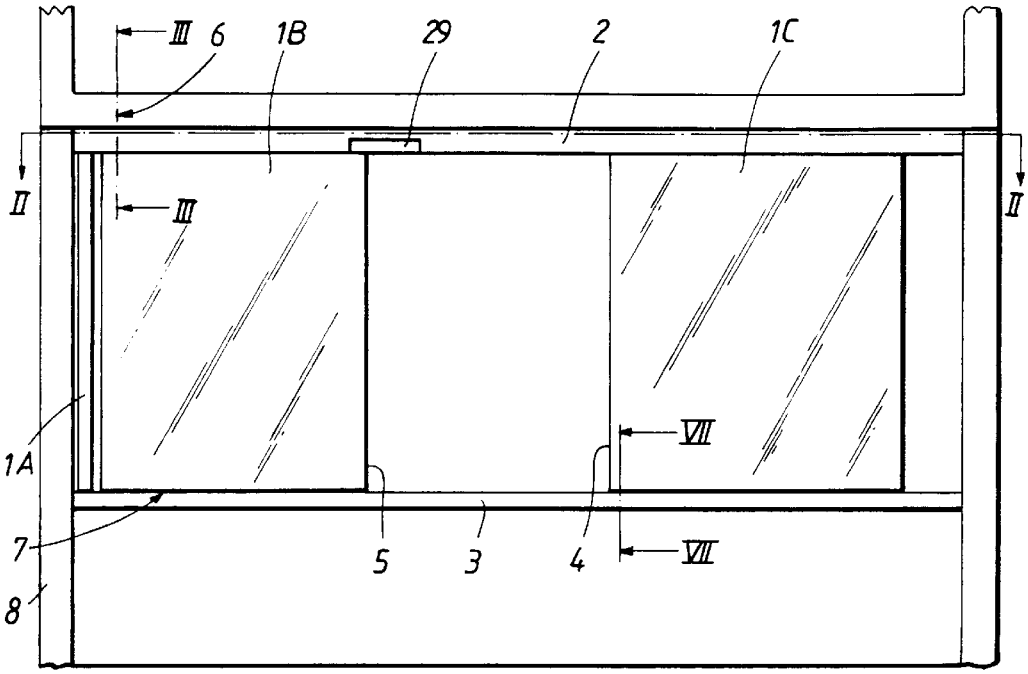
FIG. 1 is a schematic view of a glazing structure according to the present invention installed on a balcony.
Figure 2:
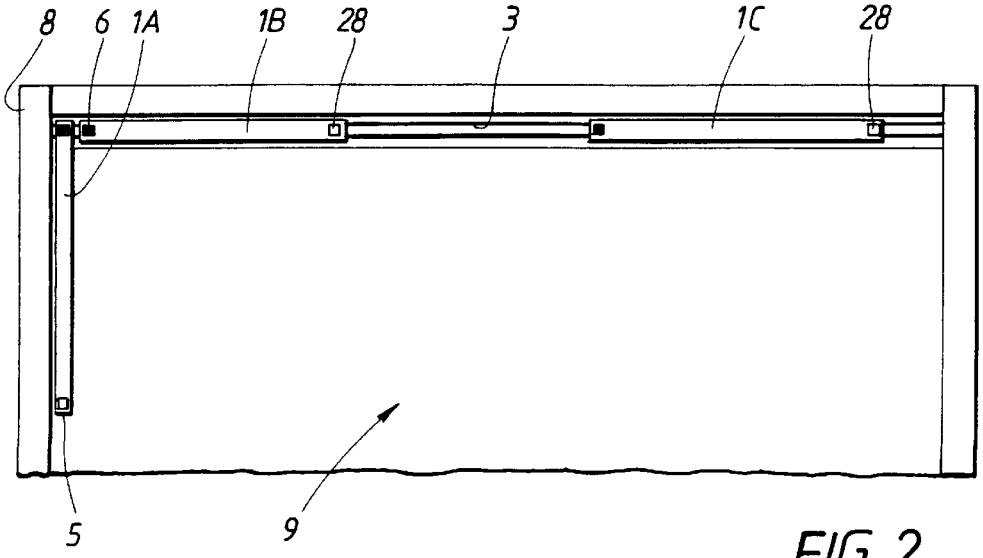
FIG. 2 is a schematic view along line II—II of FIG. 1.

A glazing structure in accordance with the present invention is shown in FIGS. 1 and 2 and comprises a plurality of glass panes 1A, 1B, 1C supported for horizontal sliding movement between an upper guide-rail 2 and a lower guide-rail 3. Each pane presents a leading edge 4 and a trailing edge 5. The panes 1B and 1C are adapted to be slid along the guide-rails to the left as shown in the drawings until the leading edge 4 of each pane reaches a predetermined position at which the pane is locked against further sliding motion and can be pivoted about a pivot arrangement shown schematically in FIGS. 1 and 2 and denoted by reference numerals 6, 7. The pivot arrangement is carried by the pane in the vicinity of the leading edge 4. Each pane is supported on the upper guide-rail 2 by an upper trailing wheel 28. An opening 29 is provided in the upper guide-rail 2. The purpose of the opening 29 is to permit the upper trailing wheel 28 of each pane to exit the upper rail when each pane is pivoted about its pivot arrangement 6. The extension of the opening 29 along the upper guide-rail 2 is dependent on the number of panes which are to be stackable against the side-wall 8. In this manner, the glass panes 1A, 1B and 1C can be stacked against a side-wall 8 of a balcony, generally denoted by reference numeral 9.

Figure 4:
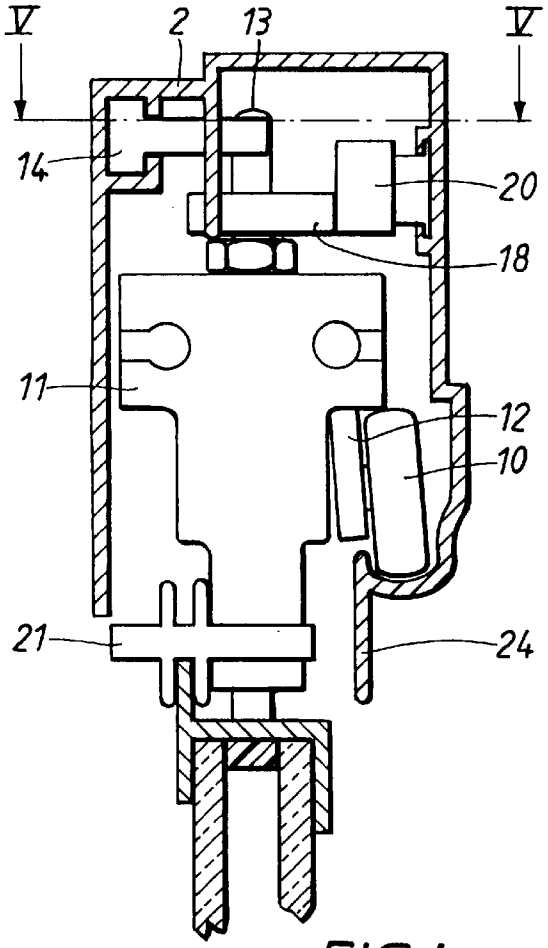
FIG. 4 corresponds to the view shown in FIG. 3, though with the structure in its locked position.
Figure 3:
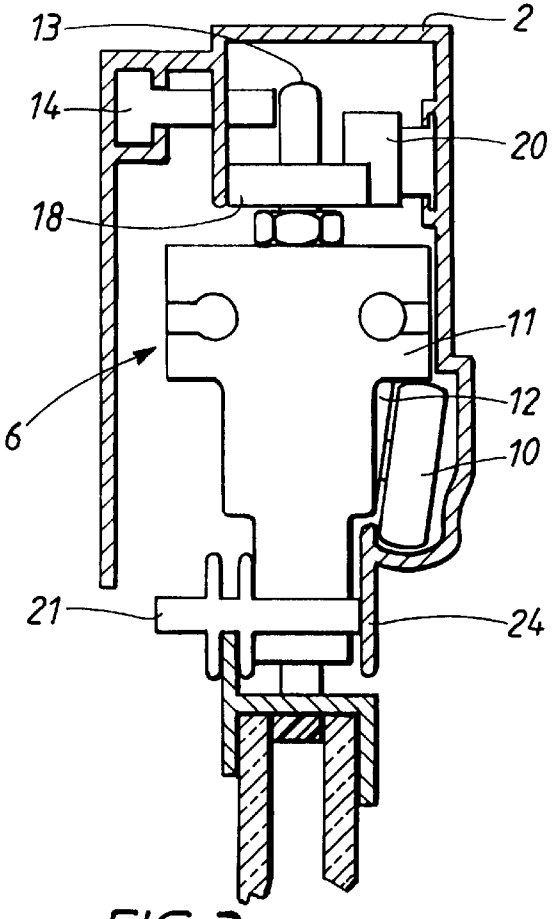
FIG. 3 is a partial sectional view along line III—III of FIG. 1 with the structure in its unlocked position.
Figure 5:
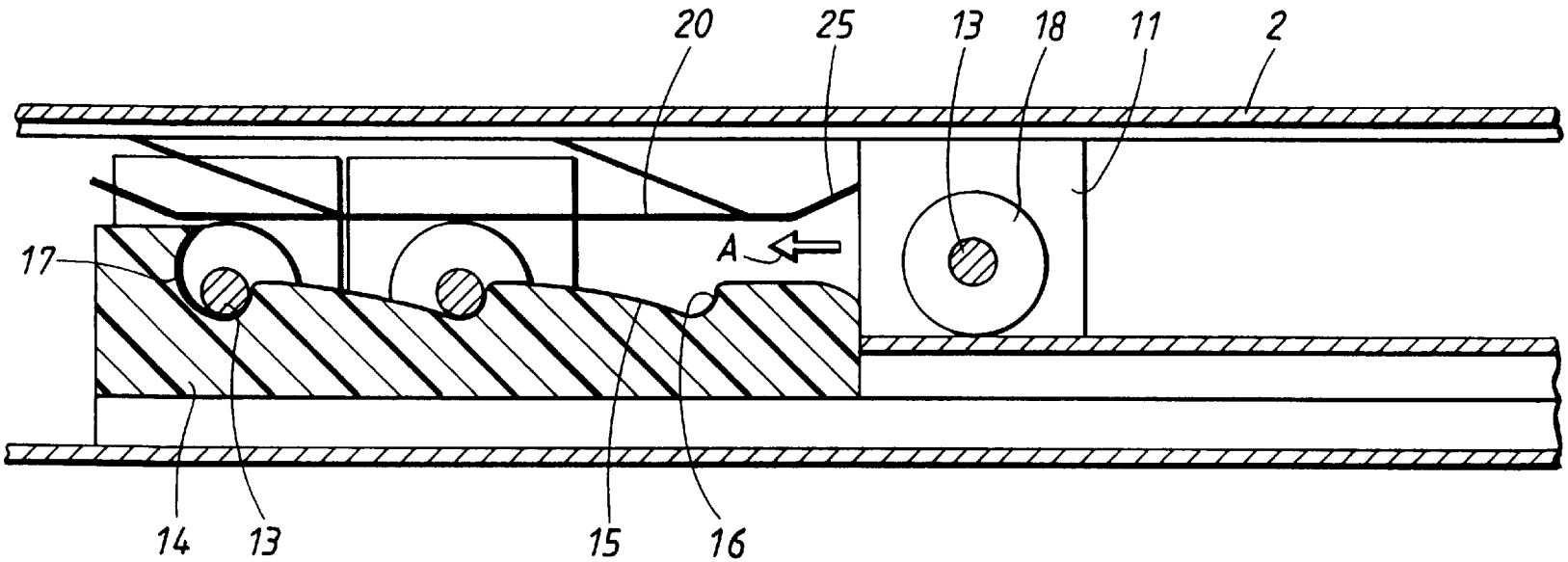
FIG. 5 is a partial sectional plan view along line V—V of FIG. 4.

The pivot arrangement 6, 7 and locking means for immobilizing the pane at said predetermined position are shown in more detail in FIGS. 3 to 5. FIG. 3 generally shows the pivot and locking arrangement within the upper guide-rail 2 of the structure, though it is to be understood that the arrangement may instead be located within the lower guide-rail 3. In the shown example, the pane is suspended at its leading edge from the upper rail 2 by a wheel 10 journalled to a carrier block 11 by means of a pivotal link arm 12. The pane is carried by the carrier block 11 by means of a first pivot pin 13 fixedly attached to the pane and passing through the carrier block 11. The pivot pin is able to rotate with respect to the carrier block 11. The vertical separation of the pane from the carrier block 11 may be adjustable by means of a not shown nut engaging a threaded portion of the first pivot pin 13, thereby allowing the pane to be aligned between the upper and lower guide-rails.

The locking means for immobilizing the pane at said predetermined position includes a receiving element 14 mounted within the guide rail 2. As best illustrated in FIG. 5, the receiving element consists of a shaped block, preferably of a hard plastics, one surface of which is provided with a plurality of wave-shaped notches 15. The number of notches corresponds to the number of openable panes included in the glazing structure. In the direction of travel indicated by arrow A, each notch presents an abrupt entry to thereby form a rear stop surface 16. From the base of the stop surface, the notch gradually shallows out until the top of the adjacent notch's stop surface is reached. The notch shown on the far left of FIG. 5 is intended to receive a portion of the first pivot pin 13 mounted to the pane 1A as shown in FIGS. 1 and 2. Thus, this latter notch is provided with a rear stop surface 16 and a curved front stop surface 17.

As most clearly shown in FIGS. 3 and 4, the portion of the first pivot pin 13 which projects upwardly out of the carrier block 11 is provided with a guide wheel 18. The guide wheel 18 is journalled to rotate about the pin 13.

In one embodiment of the invention, an elongated deflector bar 20 extending parallel to the direction of sliding movement of the panes is mounted on the guide-rail at a position at which it will be contacted by the guide wheel 18. The deflector bar is resiliently affixed to the guide rail 2 and biased in a direction substantially towards the receiving element 14.

Figure 6B:
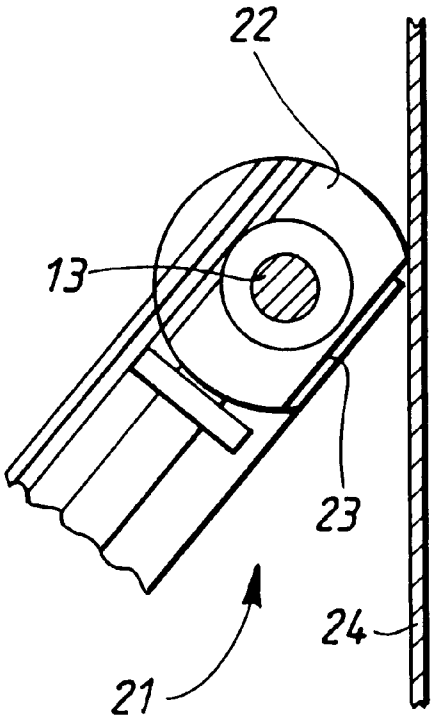
FIGS. 6A and 6B schematically illustrate an anti-release device incorporated in the structure according to the invention.
Figure 6A:
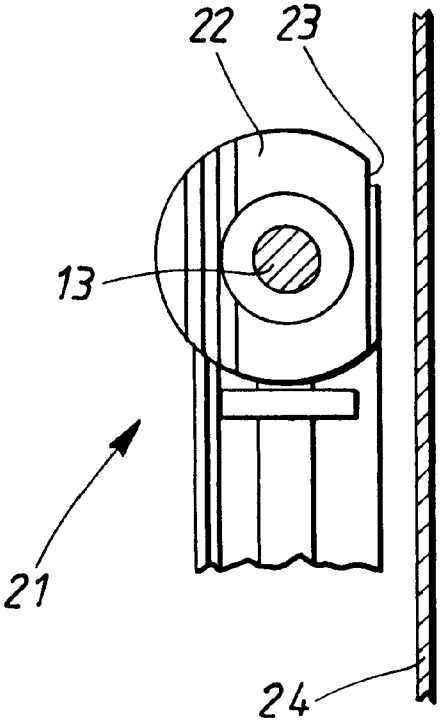

In a manner which will be described in greater detail later on, the deflector bar acts on the guide wheel 18 to maintain the upper end of the first pivot pin 13 within the recess 15 when the pane is being opened and closed. To prevent the first pivot pin 13 from being physically pushed out of the recess 15 during said opening and closing, an anti-release device 21 is affixed to the first pivot pin 13 at a position just below the carrier block 11 (see FIGS. 3 and 4). As shown in FIGS. 6A and 6B, the anti-release device 21 consists essentially of a major segment of a circular disc 22 having a chord 23. In the closed or sliding position of the pane, the chord 23 is maintained in a position substantially parallel to a lower edge portion 24 of the guide-rail 2. The diameter of the disc 22 is selected such that when the pane is opened through a small angle, say 10°, the circumference of the disc abuts the lower edge portion 24 of the guide rail to prevent the upper portion of the first pivot pin 13 from being displaced out of its recess 15.

Figure 7:
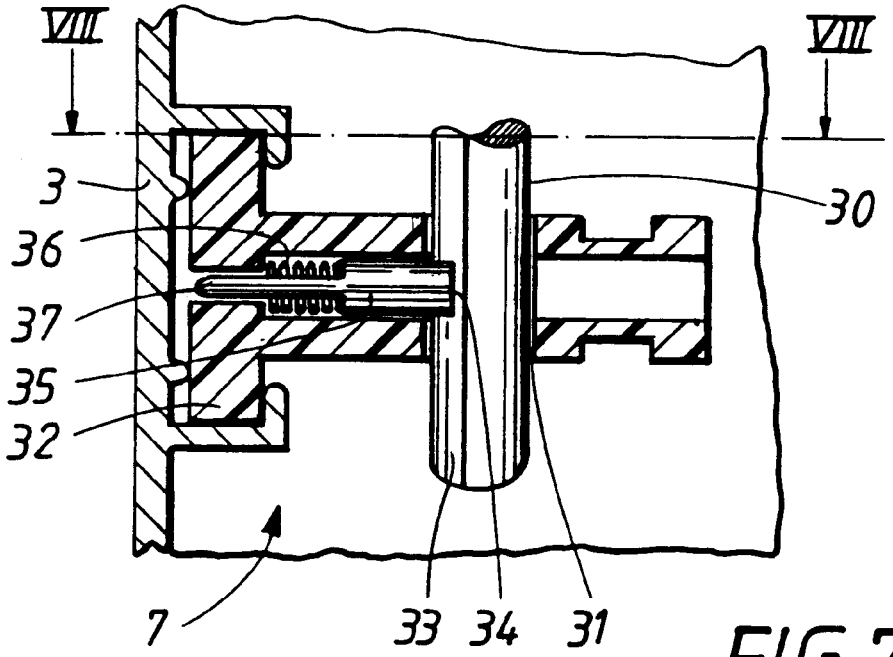
FIG. 7 is a partial sectional view along line VII—VII of FIG. 1.
Figure 8:
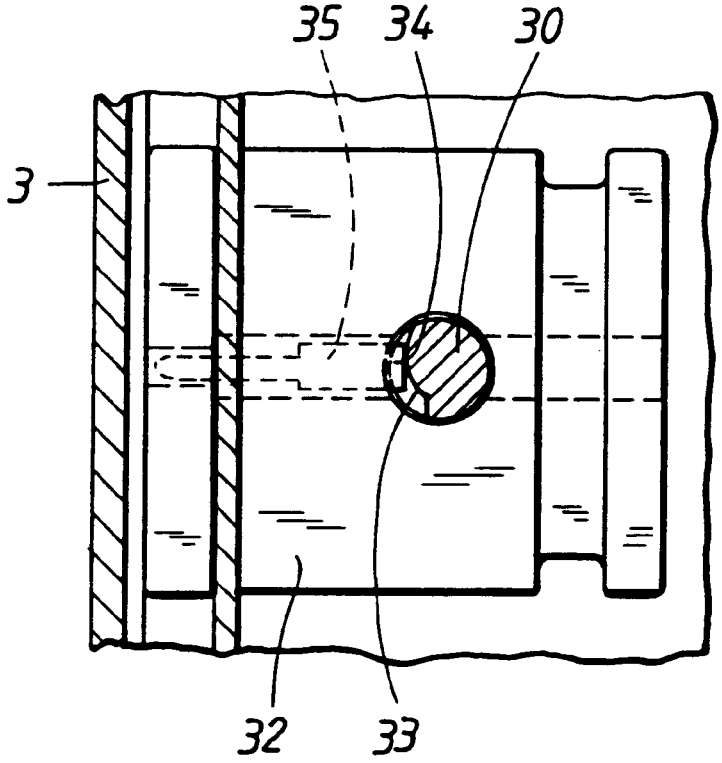
FIG. 8 is a partial sectional view along line VIII—VIII of FIG. 7.

In a preferred embodiment of the present invention shown in FIGS. 7 and 8, the pivot arrangement 6, 7 further comprises a second pivot pin 30 coaxial with the first pivot pin 13 and fixedly attached to the pane so as to extend between the pane and the lower guide-rail 3. The second pivot pin 30 projects into a through hole 31 in a slide member 32 which is arranged to slide along the lower guide-rail 3 in response to the sliding movement of the pane. So that the pane can be pivoted, i.e. opened, through more than 90°, for example if the side wall 8 of the balcony 9 is oblique to the sliding direction of the panes, means are provided for preventing sliding motion of the second pivot pin 30 along the lower guide-rail 3 as the pane is opened more than 90°. The locking means comprises a cam surface 33 on the second pivot pin 30 against which one end 34 of a friction pin 35 bears. The friction pin 35 extends through the slide member 32 transverse to the second pivot pin 30 and is biased theretowards by spring means 36. The end 37 of the friction pin 35 remote from the second pivot pin 30 is adapted to project from the slide member 32 and abut a region of the lower guide-rail 3 when the pane, and thereby also the second pivot pin 30, has rotated through 90°.

A method of performing a stacking sequence of the glass panes of the glazing structure according to the present invention will now be described for a glazing structure comprising three glass panes 1A, 1B and 1C.

From a completely closed condition in which the pane 1B is abutted on either side by panes 1A and 1C respectively, the left-hand pane 1A is pivoted to a position in which it rests against the side wall 8 of the balcony 9. Since the pane 1A does not need to perform a sliding motion along the guide-rails 2, 3, its pivot axis can be fixed with respect thereto.

As shown in FIGS. 1 and 2, the pane 1B is then slid to the left towards the predetermined position at which it can perform its pivoting motion. This position corresponds to that shown in FIG. 5 for the middle pane. As the pane 1B approaches the receiving element 14, the guide wheel 18 abuts the leading edge 25 of the deflector bar 20 so that the upper portion of the first pivot pin 13 is pressed into contact with the inwardly facing surface of the receiving element 14. During continued sliding movement of the pane towards its end position, the first pivot pin 13 is forced into the first of the notches 15 and thence on to the second shown notch. Since further sliding movement of the pane past the second notch is precluded by the interaction between the carrier blocks 11 of the panes 1A and 1B, the upper portion of the first pivot pin 13 is maintained within the middle notch as shown in FIG. 5.

The pane 1B can now be opened. During said opening, the disc 22 of the anti-release device 21 comes into contact with the lower edge portion 24 of the guide-rail 2 so that the pane 1B cannot be pushed against the action of the biased deflector bar 20. Once the pane 1B has been opened through 90°, the adjacent pane 1C can be slid along so that its first pivot pin 13 is engaged in its respective notch 15 to thereby allow the pane 1C to be opened.

In the case in which the balcony side-wall 8 forms an angle greater than 90° to the sliding direction of the panes, the second pivot pin 30 is immobilized on the lower guide-rail 3 in the following manner.

In the closed, i.e. sliding, position of the pane 1B or 1C, the end 34 of the friction pin 35 is biased towards the position on the cam surface 33 of the second pivot pin 30 at which the remote end 37 of the friction pin is fully retracted within the slide member 32. Upon rotation of the pane, the friction pin is progressively displaced to the left in FIG. 7 so that the remote end 37 of the friction pin 35 begins to project from the slide member 32. Upon the pane reaching an open position corresponding to rotation through 90°, the end 34 of the friction pin abuts the circumference of the second pivot pin 30 such that the friction pin 35 is displaced sufficiently far to the left to firmly abut against the lower guide rail 3, thereby locking the slide member in that position. Accordingly, the second pivot pin 30 is immobilized along the guide rail.

When it is desired to return the panes 1A, 1B and 1C to their closed positions, the pane 1C, is rotated back to the position in which it lies parallel to the guide-rails 2, 3. In this position, the chord 23 of the disc 22 of the anti-release mechanism 21 is aligned with the lower edge portion 24 of the guide-rail 2 so that the leading edge 4 of the pane can be pushed outwards to thereby disengage the upper portion of the first pivot pin 13 from the notch 15 in the receiving element 11. The pane can then be slid unhindered along the guide-rails to its initial position as shown in FIGS. 1 and 2. Thereafter, the pane 1B is closed, pressed outwards and slid to the right until its trailing edge 5 abuts the leading edge 4 of the pane 1C. Finally, the pane 1A is rotated to a closed position.

From the above it will be apparent that once a pane reaches the position at which it is to be opened, it is prevented from further sliding motion by, on one side, the adjacent already opened pane and, on the other side, the rear stop surface 16 acting on the upper portion of the first pivot pin 13. To return the pane to its original position it is necessary merely to press the leading edge outwards, for example by gently leaning of the pane, and to slide the pane to the right as shown in the drawings.

In a simplified embodiment of the structure according to the invention, the upper guide rail 2 is arranged parallel to, though slightly offset from, the lower guide rail 3 so that when the glass panes 1A, 1B, 1C are in their closed position they lean slightly inwardly. In this manner, the weight of each pane ensures that the guide wheel 18 (see FIG. 3) is in contact with the upper guide rail 2. Such an arrangement renders the deflector bar 20 superfluous since, during the stacking sequence of the panes, as each pane approaches the receiving element 14, the force of gravity causes the first pivot pin 13 to enter the notches 15. As in the previously described embodiment, in order to disengage the first pivot pin 13 from the notch 15 in which it is resting, it is necessary merely to push the leading edge of the pane outwardly and to slide the pane along the guide-rails.

The present invention is not to be construed as being restricted to the embodiments described above and shown in the drawings, but may be varied within the scope of the accompanying claims. For example, in the embodiment in which a spring force is required to displace the first pivot pin into its notch, this may be provided by a spring positioned between the carrier block 11 and the pivotal link arm 12.

What is claimed is:

1. A glazing structure comprising upper and lower guide-rails, a receiving element mounted on one of said guide-rails, and at least one pane supported between said guide-rails for horizontal sliding movement therealong, each said at least one pane having a leading edge, a trailing edge, and a pivot arrangement near the leading edge, said pivot arrangement being adapted for allowing said pane to perform a pivoting motion about said leading edge at a position for each pane along said guide-rails, said structure further comprising means for locking said pivot arrangement against further sliding movement at said position before and during said pivoting motion, said means for locking said pivot arrangement at said position comprising means for displacing a portion of said pane inwardly to cause at least a part of said pivot arrangement to enter and to be held in said receiving element;

wherein said pivot arrangement includes a first pivot pin extending between said pane and one of said guide-rails, and said receiving element comprises an elongated block provided with a plurality of wave-shaped notches for accommodating a portion of said first pivot pin.

2. The structure as claimed in claim 1, wherein at said position, said portion of said first pivot pin is urged into one of said notches by spring force.

3. The structure as claimed in claim 1, wherein at said position, said portion of said first pivot pin is urged in one of said notches by gravity.

4. The structure as claimed in claim 2, wherein when said pane commences its pivoting motion, an anti-release device associated with said first pivot pin prevents said portion of said first pivot pin from exiting said notch.

5. The structure as claimed in claim 3, wherein when said pane commences its pivoting motion, an anti-release device associated with said first pivot pin prevents said portion of said first pivot pin from exiting said notch.

6. The structure as claimed in claim 4 or claim 5, wherein said anti-release device consists essentially of a major segment of a circular disc having a chord which, in a position selected from a group of positions consisting of a closed position and a sliding position of the pane, is maintained in a position substantially parallel to a lower edge portion of the guide-rail.

7. The structure as claimed in claim 6, wherein said pivot arrangement further comprises a second pivot pin arranged coaxially with said first pivot pin so as to extend between said pane and another of said guide-rails.

8. The structure as claimed in claim 7, wherein means are provided for locking said second pivot pin when said pane has opened approximately 90°.

9. The structure as claimed in claim 8, wherein said means comprises a cam surface on said second pivot pin and a friction pin extending transversely to said second pin and spring-biased theretowards.

10. The structure as claimed in claim 9, wherein when said pane is in its closed position, said portion of said first pivot pin is adapted to be released from said notch by pressing the leading edge of the pane outwards.

11. A glazing structure comprising:

upper and lower guide-rails, a receiving element mounted on one of said guide-rails, and at least one pane supported between said guide-rails for horizontal sliding movement therealong, each said at least one pane comprising:

a leading edge, a trailing edge, a pivot arrangement adapted to allow said at least one pane to perform a pivoting motion about said leading edge at a position for each said at least one pane along said guide-rails, wherein said pivot arrangement comprises a first pivot pin extending between said pane and one of said guide-rails, and said receiving element comprises an elongated block provided with a plurality of wave-shaped notches for accommodating a portion of said first pivot pin, and means for locking said pivot arrangement against further sliding movement at said position before and during said pivoting motion, said means for locking said pivot arrangement at said position comprising means for displacing a portion of said pane inwardly to cause at least a part of said pivot arrangement to enter and to be held in said receiving element.

12. The structure as claimed in claim 11, wherein at said position said portion of said first pivot pin is urged into one of said notches by spring force.

13. The structure as claimed in claim 11, wherein at said position said portion of said first pivot pin is urged in one of said notches by gravity.

14. The structure as claimed in claim 12, wherein when said pane commences its pivoting motion, an anti-release device associated with said first pivot pin prevents said portion of said first pivot pin from exiting said notch.

15. The structure as claimed in claim 13, wherein when said pane commences its pivoting motion, an anti-release device associated with said first pivot pin prevents said portion of said first pivot pin from exiting said notch.

16. The structure as claimed in claim 14 or claim 15, wherein said anti-release device consists essentially of a major segment of a circular disc having a chord which, in a position selected from a group of positions consisting of a closed position and a sliding position of the pane, is maintained in a position substantially parallel to a lower edge portion of the guide-rail.

17. The structure as claimed in claim 16, wherein said pivot arrangement further comprises a second pivot pin arranged coaxially with said first pivot pin so as to extend between said pane and another of said guide-rails.

18. The structure as claimed in claim 17, wherein means are provided for locking said second pivot pin when said pane has opened approximately 90°.

19. The structure as claimed in claim 18, wherein said means comprises a cam surface on said second pivot pin and a friction pin extending transversely to said second pin and spring-biased theretowards.

20. The structure as claimed in claim 19, wherein when said pane is in its closed position, said portion of said first pivot pin is adapted to be released from said notch by pressing the leading edge of the pane outward.

* * * * *